US006869208B2

(12) United States Patent
Vogel et al.

(10) Patent No.: US 6,869,208 B2
(45) Date of Patent: Mar. 22, 2005

(54) ILLUMINATED ANIMATED ORNAMENT

(75) Inventors: David S. Vogel, New York, NY (US); Dean DiPietro, New York, NY (US)

(73) Assignee: Vogel Applied Technologies, New York, NY (US)

( * ) Notice: Subject to any disclaimer, the term of this patent is extended or adjusted under 35 U.S.C. 154(b) by 0 days.

(21) Appl. No.: 10/034,579

(22) Filed: Dec. 28, 2001

(65) Prior Publication Data

US 2002/0089856 A1 Jul. 11, 2002

Related U.S. Application Data

(60) Provisional application No. 60/259,287, filed on Jan. 2, 2001.

(51) Int. Cl.[7] ..... F21V 17/02

(52) U.S. Cl. ..... 362/363; 362/35; 362/284; 362/324; 362/431

(58) Field of Search ..... 362/363, 35, 284, 362/324, 431, 806, 808, 809; 40/429, 430, 431, 502, 503

(56) References Cited

U.S. PATENT DOCUMENTS 3,303,582 A * 2/1967 Farquhar ..... 434/288
4,173,038 A * 10/1979 Kiefer ..... 362/35
4,493,648 A * 1/1985 Suzuki ..... 192/40
5,379,271 A * 1/1995 Moedt ..... 368/24
5,552,975 A * 9/1996 Ho ..... 362/324
6,022,118 A * 2/2000 Wu ..... 362/122

FOREIGN PATENT DOCUMENTS

FR 2575575 * 7/1984 ..... G09B/27/08
FR 2575575 * 4/1986 ..... G09B/27/08

* cited by examiner

*Primary Examiner*—Alan Cariaso
*Assistant Examiner*—Mark Tsidulko
(74) *Attorney, Agent, or Firm*—Cohen, Pontani, Lieberman & Pavane

(57) ABSTRACT

An animated ornament comprises inner and outer hollow globes mounted to a housing which contains powering components to rotate the inner globe while the outer globe is held fixed relative to the housing. A light bulb mounted inside illuminates the inner globe to project an image carried on the surface of the inner globe onto the surface of or through the outer globe, and due to the rotation of the image, an animated presentation of the image is seen.

21 Claims, 6 Drawing Sheets

ILLUMINATED ANIMATED ORNAMENT

This application claims the benefit of Provisional Application No. 60/259,287, filed Jan. 2, 2001.

BACKGROUND OF THE INVENTION

1. Field of the Invention

The present invention relates to an illuminated animated ornament that can be viewed or displayed in a home, office or other location as a decorative item. A portion of the ornament bearing an image is rotated so that, to a stationary viewer, the image appears to move. In one of many uses thereof, the illuminated animated ornament is a Christmas tree ornament.

2. Description of the Related Art

Rotating decorative items are known and used for various ornamental purposes. One known rotating decorative item is a convection projection lamp. In that lamp, a light bulb is located inside a cylindrically-shaped shade. The cylindrical shade is oriented vertically, with the lower end of the shade being open and the upper end being covered with a turbine blade assembly. The shade is supported hanging on a needle bearing at the shade's central axis. The bearing is positioned so that the shade's center of gravity is below the point of the shade support. Heat generated by the bulb when it is illuminated creates a convection air current flow from the bottom to the top within the shade. The heated air current which exits the shade top by way of the turbine blade assembly causes the shade to rotate about its vertical axis on the needle bearing. The shade is a transparent element with its surface carrying colored translucent images. A fixed screen of translucent material encircles the exterior of the shade. Light from the bulb projects the shade images onto the screen, so that the rotating movement of the shade produces the effect of moving the images on the screen.

A disadvantage of the known rotating lamp is that the single point support of the shade cannot always prevent yaw of the shade during rotation thereof, so that the shade can strike against the inside surface of the fixed screen causing disruption of optimum projection and viewing of the images. The problem of shade yaw is particularly aggravated with the single point support arrangement when the shade is long. When a rotating shade lamp with a needle bearing is used on a Christmas tree, it is difficult to ensure that the ornament is perfectly vertical for proper convection air current flow so that the ornament rotates properly.

Additionally, the rotating lamp requires a strong heated air flow to produce proper shade rotation. To ensure proper rotation, a bulb must be used with large wattage and/or size, with associated power consumption, size and weight disadvantages. Where a rotating ornament is to be of compact size, such as for use as a tree ornament, it is important to minimize the size of the bulb and the turbine drive while still maintaining sufficient sizing to allow for convection air flow to produce shade rotation.

SUMMARY OF THE INVENTION

Accordingly, it is an object of the invention to provide an illuminated animated ornament that utilizes positive electric drive to rotate an image projector, thereby allowing for use of the ornament in miniaturized form.

Another object is to provide an illuminated animated ornament in a ball shape similar to the shape of a traditional Christmas tree ornament.

Another object is to provide an illuminated animated ornament wherein a rotating inner globe carrying images is viewed through an outer fixed globe that can also carry images, thereby producing special and unusual viewing effects.

In accordance with the invention, the illuminated animated ornament includes a housing for operating components including a socket for a light bulb, a motor, and a drive train for transmitting motive output from the motor to drive ring. A hollow projector globe is removably mounted to the drive ring, which causes the projector globe to rotate. Light from the light bulb projects an image on the projector globe onto a surface of a surrounding hollow projection screen globe. In one embodiment the housing is positioned above the projector globe, and the projection screen globe. In another embodiment the housing orientation is inverted, with the projector globe and the projection screen globe sitting on top the housing.

The projector globe is preferably transparent but may alternatively be frosted, and has translucent images printed or otherwise affixed to the globe's surface, for example by heat shrinking a transparent strip bearing the images. The images are selected so as to be appropriate for the ornament's intended use. Thus, if the ornament is for use as a Christmas tree ornament, the image may be, for example, of Santa Claus riding off into the sky above a snow clad country village on a reindeer drawn sleigh filled with presents.

The projection screen globe, in which the projector globe fits concentrically, is preferably frosted or provided with a translucent white strip which may be fitted around the outer globe by heat-shrinking. Since the projector globe is to be enclosed closely by the projection screen structure, the projection screen globe is made as two molded plastic parts which are joined together. The projector globe is also conveniently manufactured as two molded plastic parts. The projector globe is mounted to the housing shell so that it rotates inside the projection screen globe by operation of the motor and drive train assembly. Both globes are provided with openings for access to the bulb.

In operation, light from the light bulb transmits the images on the surface of the projector globe onto the frosted or translucent surface of the projection screen globe. As the projector globe rotates, the projected images move around the projection screen globe. Alternatively, the projection screen globe may be transparent, allowing the surface of the projector globe to be seen therethrough. When the outer globe is transparent, the images on the inner projector globe may be seen through any areas of the outer globe that are not decorated. In this embodiment, an internal light bulb may be omitted.

Although the projector globe and projection screen globe are preferably spherical in shape, they may have alternative shapes which allow for relative rotation about a central axis, such as a cone shape or a diamond shape.

Additionally, one or more lenses may be mounted into or on the surface of the projection screen globe to enlarge the image or provide various visual effects.

Although one purpose for making the projector globe removable is so that the light bulb may be replaced, making the projector globe removable allows the user to substitute another projector globe with a different image.

Although the components of the ornament are disclosed as being removable so as to facilitate replacement of the light bulb, alternatively none of the components may be removable so as to make the entire ornament an item that may be disposed of when at the end of the useful life of the light bulb.

Other objects and features of the present invention will become apparent from the following detailed description considered in conjunction with the accompanying drawings. It is to be understood, however, that the drawings are intended solely for purposes of illustration and not as a definition of the limits of the invention.

DETAILED DESCRIPTION OF THE PRESENTLY PREFERRED EMBODIMENTS

Although the illuminated animated ornament of the present invention is described herein as a ball configured for use as Christmas tree ornament and having images appropriate for that use, it will be understood that the ornament can also have other uses with other appropriate animated images, such as a sailboat before the wind, or a train climbing a mountain, an illustrated text message, advertising, etc.

Figure 1:
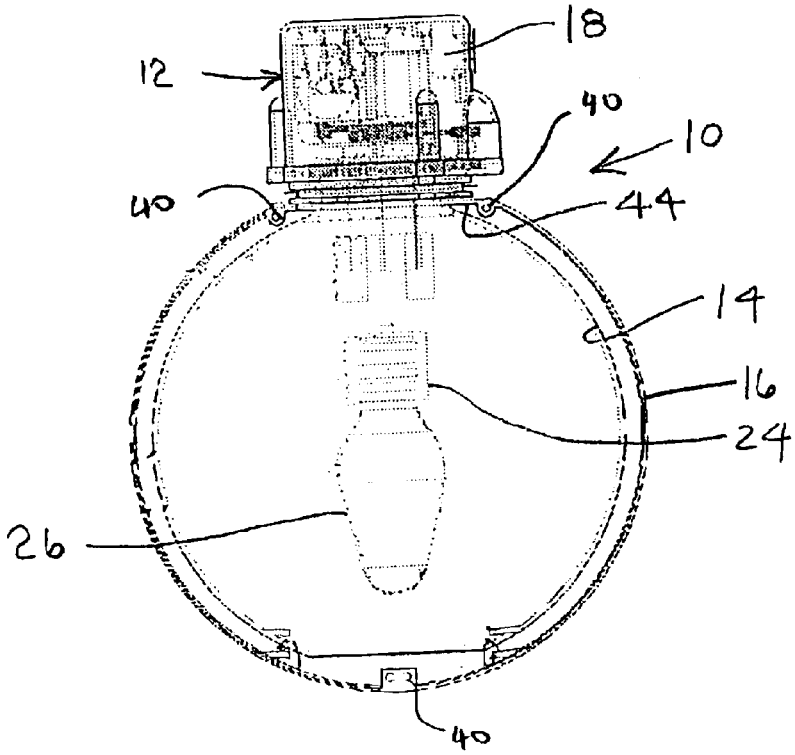
FIG. 1 is a side view of the ornament of the present invention, sans images, with internal portions of the ornament depicted in phantom.
Figure 2:
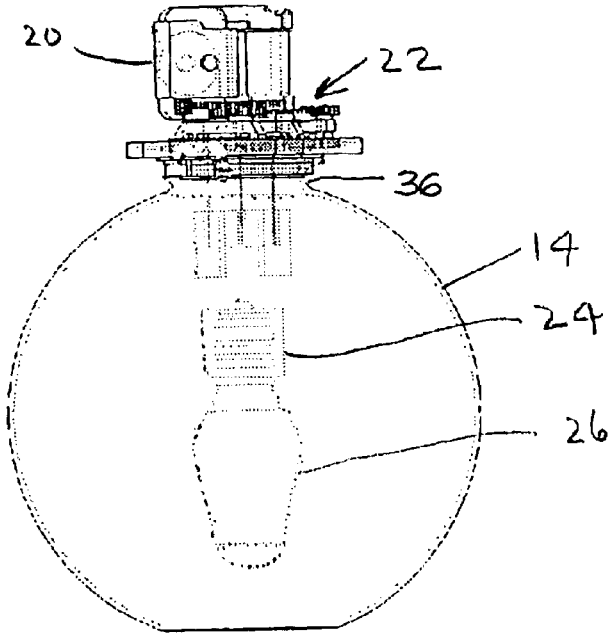
FIG. 2 is a side cross-sectional view of the illuminated animated ornament of the present invention as in FIG. 1, with the projection screen globe removed.

Referring to FIGS. 1 and 2, the illuminated animated ornament 10 includes a hollow spherical projector globe 14, and a larger hollow spherical projection screen globe 16 which encloses the projector globe 14, the inner surface of screen globe 16 being closely spaced from the outer surface of the projector globe 14, and a housing 12 within which are housed various operating components. The projector globe 14 and the projection screen globe 16 hang supported from the housing 12. The ornament 10 is about five inches high, this dimension including the outer diameter of projection screen globe 16 and the height of the housing 12, which is about one inch. The ornament 10 may alternatively be larger or smaller depending upon its particular intended use.

Figure 3:
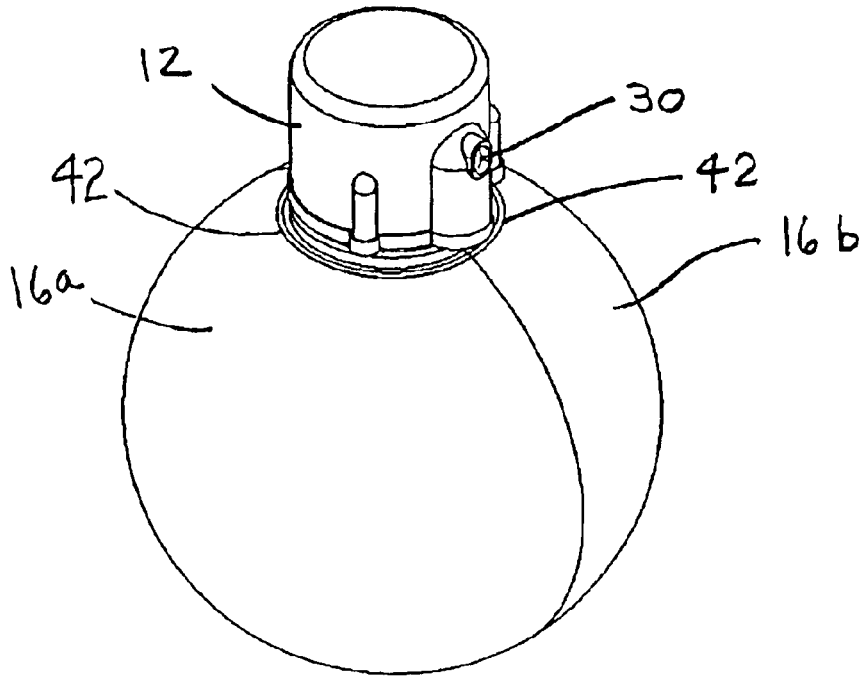
FIG. 3 is a perspective view of the illuminated animated ornament of the present invention showing the two-part construction of the projection screen globe.
Figure 4:
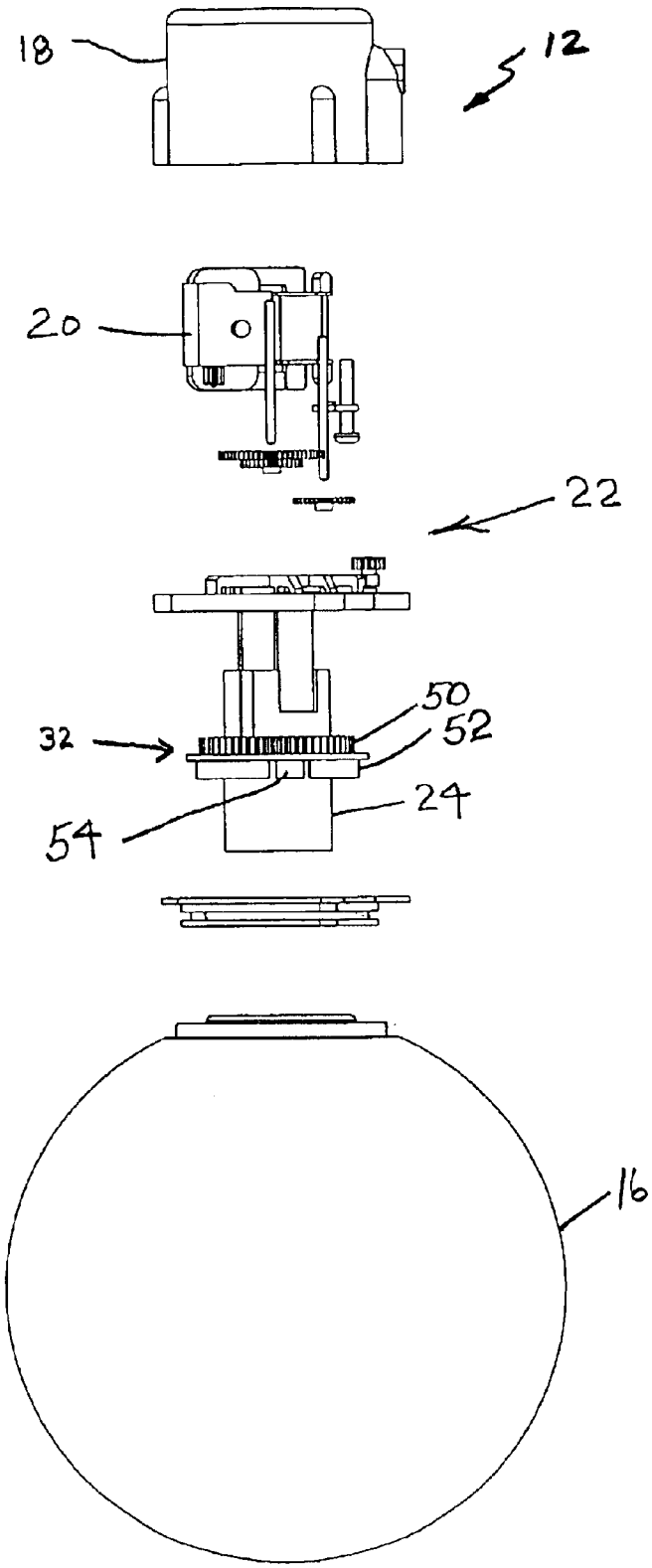
FIG. 4 is an exploded perspective view of the ornament of the present invention showing the components of the power drive train with which the projector globe is rotatively driven.
Figure 6:
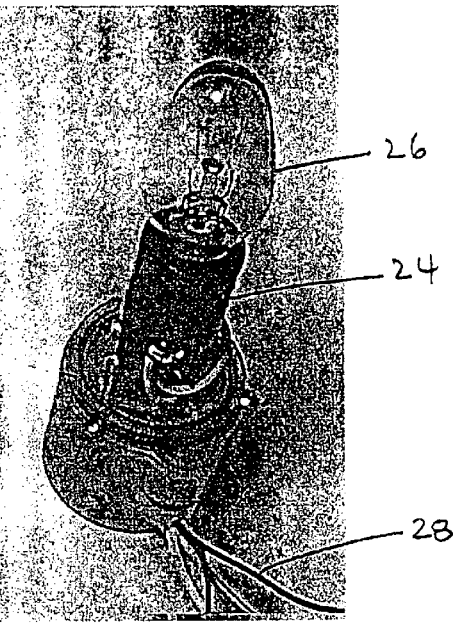
FIG. 6 is a perspective view of the housing with a bulb therein of the ornament of the present invention.

As shown in FIG. 4, the housing 18 houses a number of operating and electrical circuitry components, including a drive motor 20, a gear train and drive assembly (collectively designated 22), a light socket 24 which receives a light bulb 26, as shown in FIGS. 1 and 2, and other electrical circuit components, including wiring 28, shown in FIG. 6, for electrically connecting the housing components to an external power supply. The wiring 28 passes through housing port 30, shown in FIG. 3, and feeds power into the housing from an external power source which may be direct current or alternating current.

When assembled, the components shown in the exploded view of the gear train and drive assembly 22 of FIG. 4 fit within the housing 18 as shown in FIGS. 1 and 2. Located at the bottom of the assembly is a drive ring 32 which rotatively drives the projector globe 14 during ornament operation. The drive ring 32 includes, as unitary structure, a driven gear 50 and a snap fit collar 52 having resilient retaining tangs 54.

Projector globe 14 has a top center opening 34 with an encircling neck flange 36 which is received in the collar 52 of the drive ring 32 by the globe neck flange 36 and retained by ridged tangs 54, preferably three such tangs being provided. In this manner, the projector globe 14 is rotatable relative to the housing upon rotation of the driven gear 50 of the drive ring 32. With projector globe 14 mounted, the light socket 24 and light bulb 26 extend into globe 14, as shown in FIGS. 1 and 2.

Projection screen globe 16, as shown in FIG. 3, is preferably made as a two-piece component for ease in assembly. The two hollow hemispherical parts 16*a*, 16*b* of the projection screen globe 16 are assembled together about the projector globe 14. The hemispherical parts 16*a*, 16*b* have a top opening edge 42 to provide clearance when assembled for accommodating the structure of the housing 12 and lower part of the gear and drive train assembly. The hemispherical parts 16*a*, 16*b* have a plurality of companion projection pins and receptor passages 40, as shown in FIG. 1, which interfit with one another to hold the hemispherical parts 16*a*, 16*b* together without the need for an adhesive. The hemispherical parts 16*a*, 16*b* are mounted about the projector globe 14 onto the housing 12. For such purpose, the hemispherical parts 16*a*, 16*b* preferably each have a molded channel 44 which interfits with a flange on the lower part of the housing 12. The projection screen globe 16 thus is fixed to the housing 12.

Figure 5:
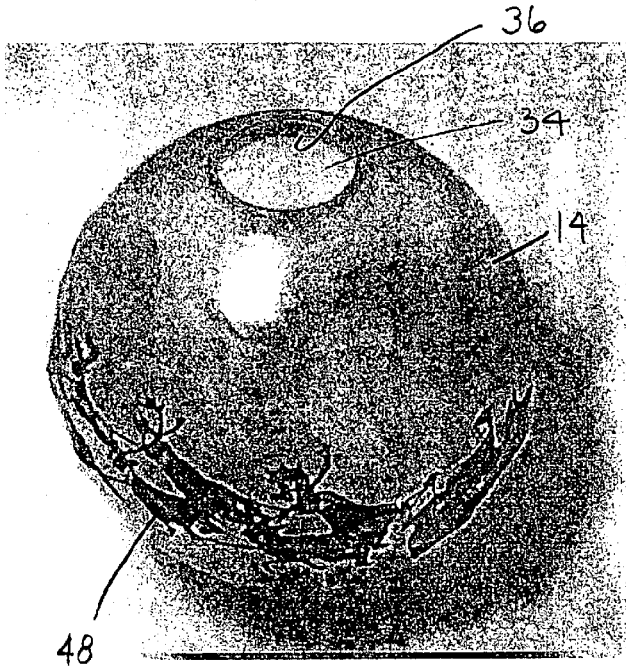
FIG. 5 is a view of the projector globe of the ornament of the present invention showing a translucent image with a Christmas motif printed on the surface thereof.

FIG. 5 shows an image 48 that has been applied to the outside of projector globe 14. The image 48 shown is of Santa Claus in his reindeer drawn sleigh in keeping with an intended use of the ornament of the present invention as a Christmas tree ornament. FIG. 6 shows a bulb 26 which is an incandscent lamp in a clear envelope. When the projector globe 14 is rotated, the light from the bulb 26 projects the image 28 onto the translucent projection screen globe 16. Due to rotation of the projector globe 14, the image 48 is seen by a viewer as animated or moving.

Figure 7:
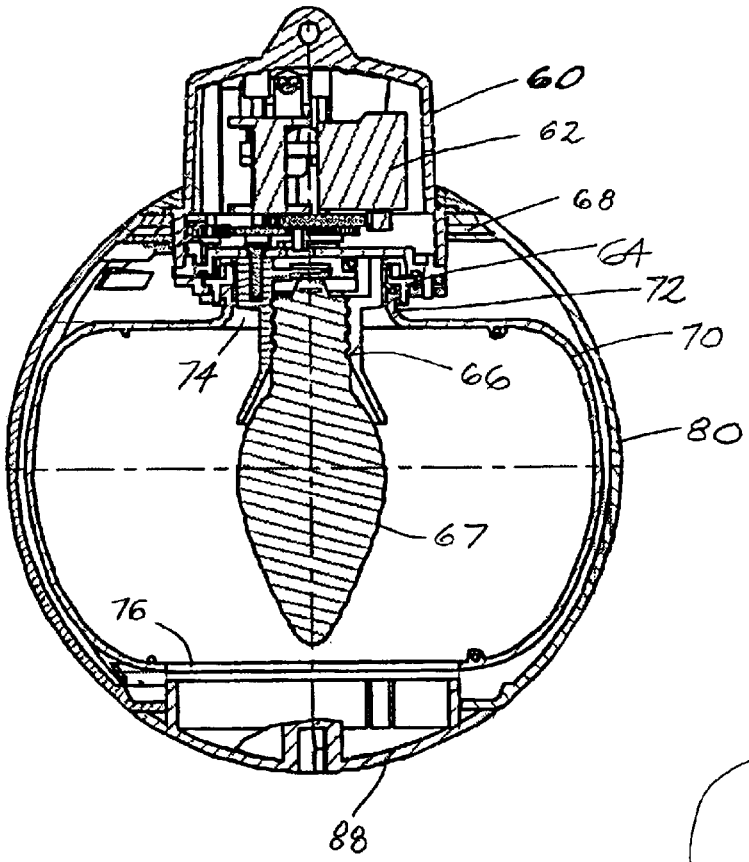
FIG. 7 is a cross-section of an alternative embodiment.
Figure 8:
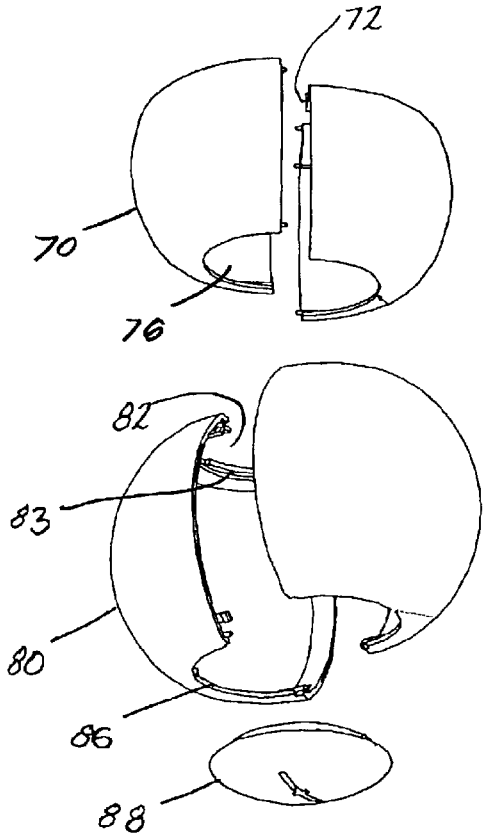
FIG. 8 is an exploded perspective view of the inner and outer globes of FIG. 7.

FIGS. 7 and 8 show an alternative embodiment having a projector globe 70 which is has a spherical central surface but is flattened at its opposed axial ends. The drive housing 60 contains a motor 62 which rotates a drive ring 64 which surrounds a stationary socket 66 for the light bulb 67. The outside of the housing 62 has a flange 68 for fixing the projection screen globe 80.

As in the first embodiment projector globe 70 has a neck 72 which is recieved in the drive ring 64 in a press fit, so that the globe 70 will rotate with the drive ring. The neck 72 surrounds a first opening 74 which accommodates the stationary light socket 66. The outer or projection screen globe 80 has a first opening 82 with channel 83 which fits on the flange 68 of the housing 60. A second opening 86 permits access for changing the bulb, and is provided with a cover 88 which has detents or the like for retention in a snap fit.

Figure 9:
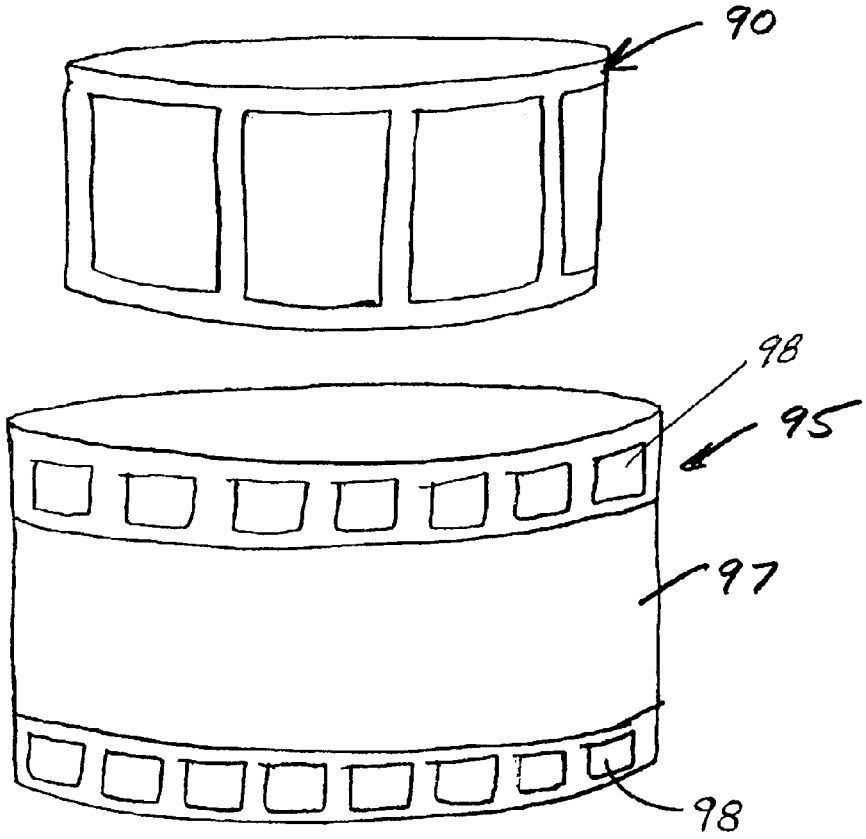
FIG. 9 is a perspective view of plastic sleeves which are shrink-fitted onto the globes of FIG. 8.

Referring to FIG. 9, the translucent imagery on the inner globe 70 and the projection screen on the outer globe 80 may be provided in the form of plastic sleeves 90, 95 which are shrink-fitted onto the globes 70, 80 respectively, thereby holding the halves of each globe together. While the sleeve on the outer globe 95 must have a screen 97 immediately adjacent to the images 92 on the inner globe 90, it may also have images 98 outside of the screen 97, which images 98 are illuminated by the bulb but do not rotate.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An apparatus for displaying images, said apparatus comprising a light transmissive inner hollow body having a central axis and a surface with images thereon, a single electric light source inside said inner hollow body, an outer hollow body surrounding said inner body and having a common central axis, said outer hollow body comprising a light transmissive material which serves as a projection screen, whereby said images can be projected onto said projection screen by said light source, said outer hollow body having a first opening concentric to said axis, said first opening being formed in two halves with a channel concentric to said axis, an electric motor which rotates said inner hollow body about said axis with respect to said outer hollow body, whereby said projected images move on said projection screen, and a housing fixed to said outer hollow body, said housing holding said electric motor and said light source, said housing being formed with a circumferential flange which is engaged by said channel when said halves are assembled.

2. An apparatus as in claim 1 wherein both said inner hollow body and said outer hollow body are at least substantially spherical and concentric.

3. An apparatus as in claim 1 further comprising a rotating member which is driven by said motor for rotation relative to said housing, said light source being fixed in said rotating member, said inner hollow body having a neck surrounding a first opening concentric to said axis, said neck engaging said rotating member.

4. An apparatus as in claim 3 wherein said inner hollow body has a second opening concentric to said axis and axially opposed from said first opening.

5. An apparatus as in claim 4 wherein said outer hollow body has a second opening concentric to said axis and axially opposed from said first opening.

6. An apparatus as in claim 1 wherein both said inner hollow body and said outer hollow body are at least substantially spherical concentric.

7. An apparatus as in claim 1 wherein said outer hollow body has an outer surface on which a translucent material is provided, said translucent material serving as said projection screen.

8. An apparatus as in claim 1 wherein said outer hollow body has a surface with translucent images thereon, said inner hollow body being free of images adjacent to said images on said outer hollow body.

9. An apparatus as in claim 1 wherein said single light source comprises a lamp having a transparent envelope.

10. An apparatus as in claim 9 wherein said lamp is an incandescent lamp.

11. An apparatus as in claim 1 wherein said images are translucent.

12. An apparatus for displaying images, said apparatus comprising an inner hollow body having a central axis and a surface with images thereon, an outer hollow body surrounding said inner body and having a common central axis, said outer hollow body having an area comprising a translucent material which serves as a projection screen onto which the images can be projected, an electric motor which rotates said inner hollow body about said axis with respect to said outer hollow body, whereby said images move with respect to said outer hollow body, and a single light source located inside said inner hollow body, whereby said images are projected onto said projection screen by said light source.

13. An apparatus as in claim 12 wherein both said inner hollow body and said outer hollow body are at least partially spherical and concentric.

14. An apparatus as in claim 12 further comprising a housing fixed to said outer hollow body, said housing holding said electric motor.

15. An apparatus as in claim 14 further comprising a rotating member which is driven by said motor for rotation relative to said housing, said inner hollow body having a neck defining a first opening concentric to said axis, said neck engaging said rotating member.

16. An apparatus as in claim 14 wherein said outer hollow body has a first opening concentric to said axis, said opening engaging said housing.

17. An apparatus as in claim 16 wherein said outer hollow body has a second opening concentric to said axis and axially opposed from said first opening, said apparatus further comprising a cover which is engageable to said outer hollow body to cover said second opening.

18. An apparatus for displaying images, said apparatus comprising an inner hollow body having a central axis and a surface with images thereon, an outer hollow body surrounding said inner body and having a common central axis, said outer hollow body having an area which provides visibility of said images, an electric motor which rotates said inner hollow body about said axis with respect to said outer hollow body, whereby said images move with respect to said outer hollow body, and at least one tubular sleeve fitted to a respective at least one of said inner hollow body and said outer hollow body, said at least one tubular sleeve bearing at least one of translucent imagery and a translucent projection screen.

19. An apparatus as claim 18 wherein both said inner hollow body and said outer hollow body are at least partially spherical and concentric.

20. An apparatus as in claim 18 further comprising a single light source located inside said inner hollow body, said at least one tubular sleeve comprising a tubular sleeve fitted to said inner hollow body and bearing translucent images.

21. An apparatus as in claim 18 wherein said at least one tubular sleeve comprises a tubular sleeve fitted to said outer hollow body and bearing a translucent projection screen.

* * * * *